US009802236B2

(12) United States Patent
Kim et al.

(10) Patent No.: US 9,802,236 B2
(45) Date of Patent: Oct. 31, 2017

(54) MULTI-WARM FORMING DEVICE AND THE FORMING METHOD THEREOF

(71) Applicant: SUNGWOO HITECH CO., LTD., Busan (KR)

(72) Inventors: Rae Hyeong Kim, Busan (KR); Mun Yong Lee, Busan (KR)

(73) Assignee: SUNGWOO HITECH CO., LTD., Busan (KR)

( * ) Notice: Subject to any disclaimer, the term of this patent is extended or adjusted under 35 U.S.C. 154(b) by 0 days.

(21) Appl. No.: 15/157,501

(22) Filed: May 18, 2016

(65) Prior Publication Data

US 2017/0136516 A1 May 18, 2017

(30) Foreign Application Priority Data

Nov. 18, 2015 (KR) ..... 10-2015-0161504

(51) Int. Cl.
*B21D 26/031* (2011.01)
*B21D 26/029* (2011.01)
(Continued)

(52) U.S. Cl.
CPC ..... *B21D 26/031* (2013.01); *B21D 22/208* (2013.01); *B21D 22/22* (2013.01);
(Continued)

(58) Field of Classification Search
CPC .. B21D 26/021; B21D 26/023; B21D 26/027; B21D 26/031; B21D 26/055; B21D 24/16; B21D 37/16
See application file for complete search history.

(56) References Cited

U.S. PATENT DOCUMENTS 6,581,428 B1 * 6/2003 Friedman ..... B21D 26/029 29/421.1
2006/0277962 A1 * 12/2006 Kruger ..... B21D 22/02 72/342.7

FOREIGN PATENT DOCUMENTS

JP 2006-055869 2/2006
KR 10-2012-0038082 4/2012

* cited by examiner

*Primary Examiner* — Debra Sullivan
(74) *Attorney, Agent, or Firm* — Lex IP Meister, PLLC

(57) ABSTRACT

A multi-warm forming device and the forming method are disclosed. A multi-warm forming device according to one or a plurality of exemplary embodiments of the present invention may include: a lower mold die that is disposed on a bolster for a process and in which a mold mounting portion having at least one space portion is formed at a center thereof; a lower mold that is disposed at an upper surface of a mold mounting portion of the lower mold die, in which a plurality of gas supply passages formed therein in a vertical direction are connected to a gas supply device of an outside through a gas supply line, and a lower forming surface is formed at an upper surface thereof; an upper mold that is mounted on a slider of an upper portion to be able to be moved up and down corresponding to the lower mold at an upper portion of the lower mold die, in which an upper forming surface is formed at a lower surface corresponding to the lower mold, an upper mold face surface is formed at a circumference of the upper forming surface, and a plurality of heating cartridges are mounted inside along the upper forming surface and the upper mold face surface; and a blank holder of which the mold mounting portion is inserted into a penetration hole that is formed corresponding to the mold mounting portion, is able to be moved in a vertical direction by a guide post and a cushion spring that are mounted within the lower mold die, and in which a plurality
(Continued)

of heating cartridges are mounted along a holder face surface that restrains a material together with the upper mold face surface at an early stage of a forming process.

17 Claims, 8 Drawing Sheets

(51) Int. Cl.

| | |
|---|---|
| ***B21D 26/055*** | (2011.01) |
| ***B21D 37/16*** | (2006.01) |
| ***B21D 22/20*** | (2006.01) |
| ***B21D 22/22*** | (2006.01) |

(52) U.S. Cl.
CPC ..... *B21D 26/029* (2013.01); *B21D 26/055* (2013.01); *B21D 37/16* (2013.01)

<S1>

<S2>

<S3>

MULTI-WARM FORMING DEVICE AND THE FORMING METHOD THEREOF

CROSS-REFERENCE TO RELATED APPLICATION

This application claims priority to and the benefit of Korean Patent Application No. 10-2015-0161504 filed in the Korean Intellectual Property Office on Nov. 18, 2015, the entire contents of which are incorporated herein by reference.

BACKGROUND OF THE INVENTION (a) Field of the Invention

The present invention is related to a multi-warm forming device and a forming method thereof. More particularly, the present invention relates to a multi-warm forming device of which one mold set performs warm forming and blow-forming having different temperature conditions from each other so as to produce a product having a complicated forming shape and a large forming depth, and a forming method thereof.

(b) Description of the Related Art

Generally, a warm forming process has been developed to form a magnesium alloy sheet of a lightweight material of which a density of the metal structure is lower than that of an aluminum alloy sheet, and has recently been under development and is being applied by demand of various press forming methods so as to apply a magnesium alloy sheet to a vehicle body for the purpose of producing a lightweight and high strength vehicle body in America.

That is, a warm forming method is performed at an intermediate temperature range between cold forming and hot forming temperatures, wherein a sheet receives heat energy from a high temperature mold that is heated by a heat source, and press forming is performed under conditions such that a yield strength is reduced and an elongation rate is improved.

The magnesium alloy sheet to which the warm forming method is applied has an HCP (hexagonal closed packed) crystal lattice structure, so it is difficult to apply a press forming method thereto at room temperature due to the crystal structure, and formability is quickly improved by a characteristic that a non-basal plane slip system is activated in a high temperature area (of higher than 200° C.).

However, the magnesium has high specific strength, and it can be light in weight at 30% lighter than an aluminum alloy, but it is disadvantageous in an aspect of cost, corrosion, formability, and welding characteristics compared to other materials such as an aluminum alloy.

Particularly, in a case that a product having a complicated shape or a product having a large forming depth is produced, there are drawbacks that the number of processes and the number of components are increased due to limitations of formability, forming cost is increased, and productivity is deteriorated.

Meanwhile, an aluminum alloy is disadvantageous in terms of weight compared to a magnesium alloy and is advantageous in an aspect of material cost and formability, and thus a die casting process has been used therewith to produce a product of which a forming shape is complicated and a forming depth is large.

However, the die casting method injects a molten metal of an aluminum alloy into a die to perform casting, wherein the facility cost is high for mass production, the number of the processes is larger, and there is a drawback in terms of productivity.

Therefore, a new forming method that uses super-plasticity as a physical characteristic of an aluminum alloy has recently attracted attention, wherein the super-plasticity is a characteristic that the material shows extreme ductility without local shrinkage when the material is deformed under a specific temperature condition.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a multi-warm forming device and a forming method thereof having advantages of performing warm forming in which a material is formed to a maximum forming depth through pressurized plastic deformation and blow-forming by which a material is formed to a final product shape at a super-plasticity temperature of the material below an annealing temperature such that dislocation density within a material having a super-plasticity characteristic is reduced such that a product can be produced by one mold set to have a deep forming depth and a complicated shape.

A multi-warm forming device according to one or a plurality of exemplary embodiments of the present invention may include: a lower mold die that is disposed on a bolster for a process and in which a mold mounting portion having at least one space portion is formed at a center thereof; a lower mold that is disposed at an upper surface of a mold mounting portion of the lower mold die, in which a plurality of gas supply passages formed therein in a vertical direction are connected to a gas supply device of an outside through a gas supply line, and a lower forming surface is formed at an upper surface thereof; an upper mold that is mounted on a slider of an upper portion to be able to be moved up and down corresponding to the lower mold at an upper portion of the lower mold die, in which an upper forming surface is formed at a lower surface corresponding to the lower mold, an upper mold face surface is formed at a circumference of the upper forming surface, and a plurality of heating cartridges are mounted inside along the upper forming surface and the upper mold face surface; and a blank holder of which the mold mounting portion is inserted into a penetration hole that is formed corresponding to the mold mounting portion, is able to be moved in a vertical direction by a guide post and a cushion spring that are mounted within the lower mold die, and in which a plurality of heating cartridges are mounted along a holder face surface that restrains a material together with the upper mold face surface at an early stage of a forming process.

The material can be applied as a super-plasticity material.

An aluminum alloy plate can be applied as the super-plasticity material.

The multi-warm forming device may further include an insulating case that is respectively mounted on an outside surface of the upper mold and the blank holder to preserve heat energy of the mold.

The insulating case may be made of a micro-porosity panel that is assembled on each outside surface of the upper mold and the blank holder.

A plurality of key grooves may be formed corresponding to an upper surface of a mold mounting portion of the lower mold die and a lower surface of a lower mold that is mounted thereon, and a restraining key that is inserted into the key groove fixes the lower mold on the lower mold die.

An upper surface of a mold mounting portion of the lower mold die may be formed as a flat mold mounting surface.

The gas supply line that is connected to an outside gas supply device may be connected to the gas supply passage through a space portion of the mold mounting portion.

The gas supply line may be disposed to penetrate a central portion of a heating unit that is configured inside a space portion of the mold mounting portion.

The heating unit may include a heater housing in which a penetration hole is formed at a center thereof and is disposed in a space portion of the mold mounting portion, and a heating coil that is wound in the heater housing.

An outside of the heating unit may be covered by a heat insulating material inside a space portion of the mold mounting portion.

The lower forming surface may be formed as an unfinished product shape surface to be able to form a material to a maximum forming depth.

The upper forming surface may be formed as a complete product shape to be able to form a material to a final complete shape.

A multi-warm forming method according to one or a plurality of exemplary embodiments of the present invention may include: a material supply step in which a plate made of a super-plasticity material is loaded on a blank holder that is mounted on a lower mold die through a guide post and a cushion spring corresponding to a circumference of a lower mold, wherein the lower mold is mounted on the lower mold die; a material heating step in which the plate is heated to a warm forming temperature through a heating cartridge configured inside the upper mold and the blank holder by moving an upper mold that is disposed at an upper portion of the lower mold to be operated by a slider downwards and by holding the edge of the plate together with the blank holder; a warm forming step that combines the upper mold and the lower mold through the operation of the slider at the warm forming temperature to deform the plate to a maximum forming depth through plastic deformation; and a blow-forming step in which the heating cartridge further heats the plate to a super-plasticity temperature in a condition that the plate is already warm-formed to a maximum forming depth, a gas is supplied through a gas supply passage that is formed inside the lower mold, and the plate is formed to a final shape of a product along an upper forming surface of the upper mold by a gas pressure in a condition that the upper mold is combined with the lower mold.

An aluminum alloy plate may be applied as the super-plasticity material.

An insulating case that is made of a micro-porosity panel may be mounted on an outside surface of the upper mold and the blank holder to preserve heat energy of a mold therein.

The gas supply passage may be connected to a gas supply device and receives a high pressure gas through a gas supply line.

The gas supply line may be covered by a heating unit that is configured inside the lower mold die and supplies a high temperature gas to the gas supply passage.

A lower forming surface of the lower mold may be formed as an unfinished product shape surface to be able to form a material to a maximum forming depth.

An upper forming surface of the upper mold may be formed as a complete product shape to be able to form a material to a final complete shape.

The warm forming temperature may be set to a value below an annealing temperature that lowers a dislocation density inside a material having a super-plasticity characteristic.

An exemplary embodiment of the present invention can perform warm forming that forms a material to a maximum forming depth through pressurized plastic deformation below an annealing temperature that lowers dislocation density within a material having a super-plasticity characteristic and then perform blow-forming that forms a material to a final product shape at a super-plasticity temperature of an aluminum alloy sheet such that a product can be produced by one mold set to have a deep forming depth and a complicated shape.

Particularly, the number of components is reduced and the cost can be saved through a minimized number of processes when a product of which a forming depth is deep and a shape is complicated is formed, and therefore there is a merit in an aspect of cost.

Further, complicated parts of a product are formed through blow-forming in which a gas pressure enlarges a material through non-contact with a mold, and thus there is a merit of minimizing inferiority defect rate compared with a conventional die casting method.

DETAILED DESCRIPTION OF THE EMBODIMENTS

Figure 1:
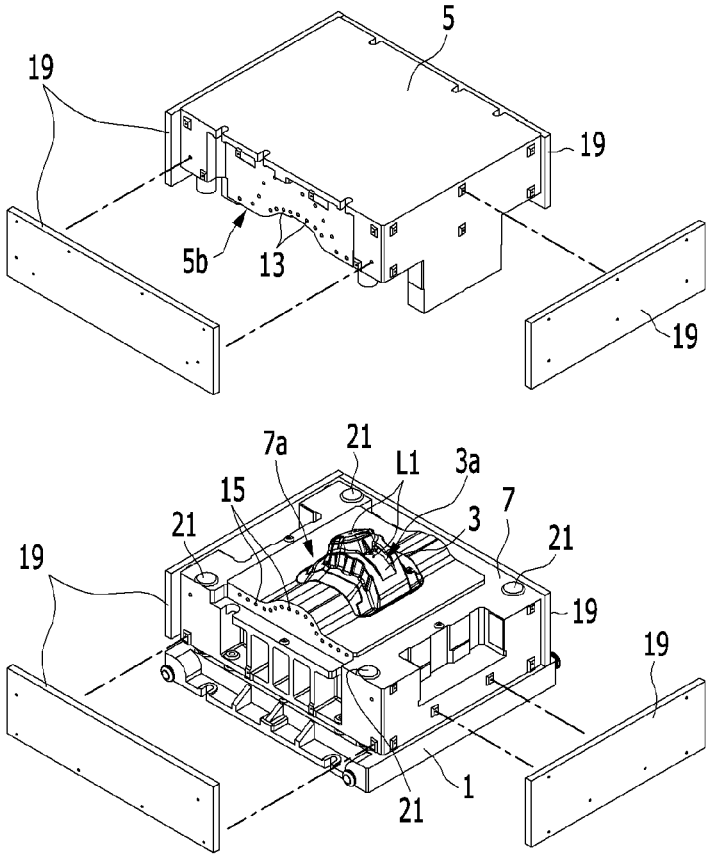
FIG. 1 is a partial exploded perspective view of a multi-warm forming device according to an exemplary embodiment of the present invention.

Hereinafter, an exemplary embodiment of the present invention will be described with reference to accompanying drawings.

Further, the sizes and thicknesses of the configurations shown in the drawings are selectively provided for convenience of description, and the present invention is not limited to those shown in the drawings, and to clearly describe the present invention, parts that are irrelevant to the description will be omitted.

Figure 2:
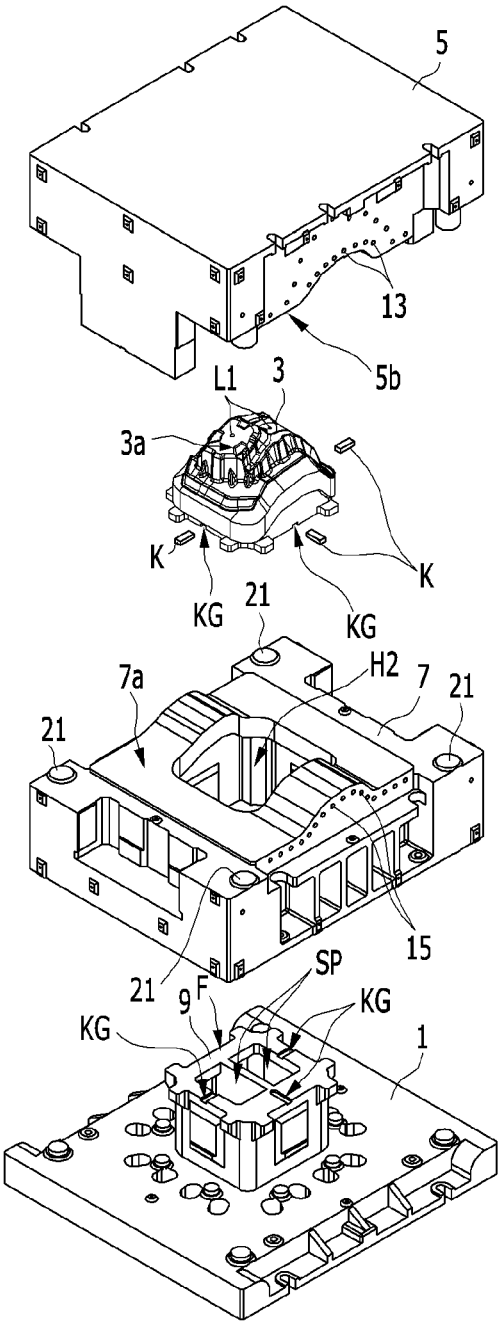
FIG. 2 is an exploded perspective view of a mold that is applied to a multi-warm forming device according to an exemplary embodiment of the present invention.
Figure 3:
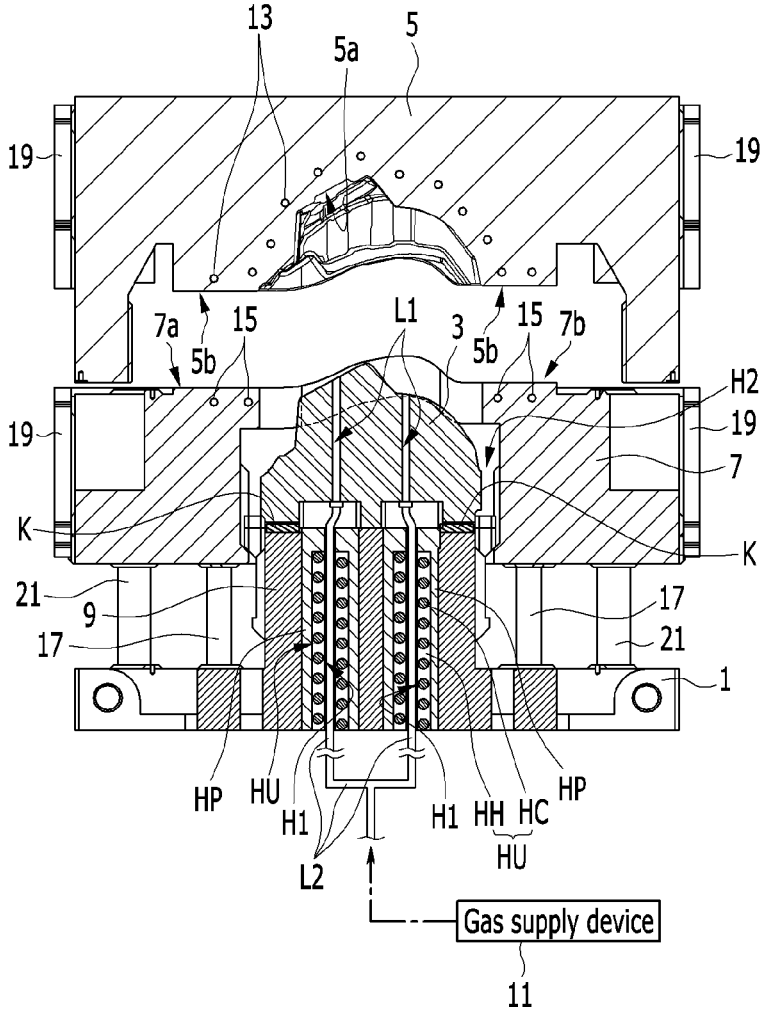
FIG. 3 is a cross-sectional view of a multi-warm forming device according to an exemplary embodiment of the present invention.

FIG. 1 is a partial exploded perspective view of a multi-warm forming device according to an exemplary embodiment of the present invention, FIG. 2 is an exploded perspective view of a mold that is applied to a multi-warm forming device according to an exemplary embodiment of the present invention, and FIG. 3 is a cross-sectional view of a multi-warm forming device according to an exemplary embodiment of the present invention.

Referring to FIG. 1 to FIG. 3, a multi-warm forming device and the forming method thereof according to an exemplary embodiment of the present invention forms an aluminum alloy sheet having super-plasticity to a maximum forming depth in a warm forming condition and then performs blow-forming to a final shape of a product.

Here, the super-plasticity material shows extreme ductility without local shrinkage when the material is deformed under a specific temperature condition, and the material can be an aluminum alloy sheet in an exemplary embodiment of the present invention.

That is, a multi-warm forming device and a forming method thereof according to an exemplary embodiment of the present invention perform warm forming that forms a material to a maximum forming depth through pressurized plastic deformation below an annealing temperature that lowers dislocation density within a material having a super-plasticity characteristic and then performs blow-forming that forms a material to a final product shape at a super-plasticity temperature of an aluminum alloy sheet such that a product can be produced by one mold set to have a deep forming depth and a complicated shape.

A multi-warm forming device according to an exemplary embodiment for realizing a technical characteristic of the present invention includes a lower mold die 1, a lower mold 3, an upper mold 5, and a blank holder 7.

The lower mold die 1 is mounted on a bolster (not shown) for a process, and a mold mounting portion 9 having two inside space portions (SP) is formed at a center thereof.

The lower mold 3 is mounted on an upper surface of a mold mounting portion 9 of the lower mold die 1, two gas supply passages L1 are formed inside in the vertical direction, and a lower forming surface 3*a* is formed on an upper surface thereof. Further, the gas supply passage L1 is connected to a gas supply device 11 that is disposed at an outside to supply a high pressure forming gas through a gas supply line L2.

Here, the lower forming surface 3*a* has an unfinished shape surface to form a material only to a maximum forming depth.

An upper surface of a mold mounting portion 9 of the lower mold die 1 is fixed to a lower surface of the lower mold 3 that is mounted thereto by key mounting, a key groove (KG) is formed at three points on an upper surface of a mold mounting portion 9 of the lower mold die 1 and a lower surface of a lower mold 3, and a holding key (K) is inserted into each key groove (KG) to fix a location of the lower mold 3 on the lower mold die 1.

An upper surface of a molding mounting portion 9 of the lower mold die 1 is formed as a flat mold mounting surface (F) such that a lower surface of the lower mold 3 is seated thereon.

Also, the gas supply line L2 that is connected to an outside gas supply device 11 is connected to two gas supply passages L1 through two space portions (SP) of the mold mounting portion 9. In this case, the gas supply line L2 is disposed to be covered by a heating unit (HU) inside two space portions (SP) of the mold mounting portion 9. That is, the heating unit (HU) is configured inside two space portions (SP) of the mold mounting portion 9, and the gas supply line L2 penetrates the center portion thereof to be disposed therein.

The heating unit (HU) includes a heater housing (HH) and a heating coil (HC), a penetration hole H1 that the gas supply line L2 penetrates is formed at a central portion of the heater housing (HH) that is disposed in a space portion (SP) of the mold mounting portion 9, and the heating coil (HC) is wound in the heater housing (HH) and heats a forming gas of the gas supply line L2 to a predetermined high temperature by a power controller.

A heat insulating material (HP) is configured in two space portions (SP) of the mold mounting portion 9 and covers an outside of the heating unit (HU) so as to insulate the heating unit (HU).

The upper mold 5 is mounted on a slider (not shown) of an upper portion to move up and down corresponding to the lower mold 3 at an upper portion of the lower mold die 1. An upper forming surface 5*a* is formed at a lower surface of the upper mold 5 corresponding to the lower mold 3, and an upper mold face surface 5*b* is formed along a circumference of the upper forming surface 5*a*.

A plurality of heating cartridges 13 are mounted inside the upper forming surface 5*a* and the upper mold face surface 5*b* to be able to heat the upper mold 5 to a predetermined temperature.

The upper forming surface 5*a* is formed with a final product shape so as to form a final shape of a product.

The blank holder 7 is disposed to move in a vertical direction through a guide post 21 and a cushion spring 17 within the lower mold die 1 in a condition that the mold mounting portion 9 is inserted into a penetration hole H2 that is formed corresponding to the mold mounting portion 9.

In the blank holder 7, a plurality of heating cartridges 15 are formed inside a holder face surface 7*a* that holds a material together with the upper mold face surface 5*b* at an early stage of a forming process, and are configured to heat the blank holder 7 to a predetermined temperature.

An insulating case 19 is mounted on each outside surface of the upper mold 5 and the blank holder 7 to conserve heat energy inside the mold, and the insulating case 19 that is assembled on each outside surface of the upper mold 5 and the blank holder 7 can be a fine-porosity insulating sheet.

Figure 4:
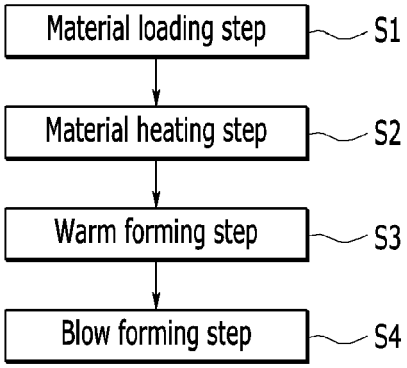
FIG. 4 is a process block diagram showing steps of a multi-warm forming device according to an exemplary embodiment of the present invention.

FIG. 4 is a process block diagram showing steps of a multi-warm forming device according to an exemplary embodiment of the present invention, and FIG. 5 to FIG. 8 show an operational state of a multi-warm forming device according to an exemplary embodiment of the present invention.

Hereinafter, referring to FIG. 4 to FIG. 7, a forming method using a multi-warm forming device according to an exemplary embodiment of the present invention will be described in stages.

Referring to FIG. 4, a forming method using a multi-warm forming device according to an exemplary embodiment of the present invention performs a material supply step S1, a material heating step S2, a warm forming step S3, and a blow-forming step S4.

Figure 5:
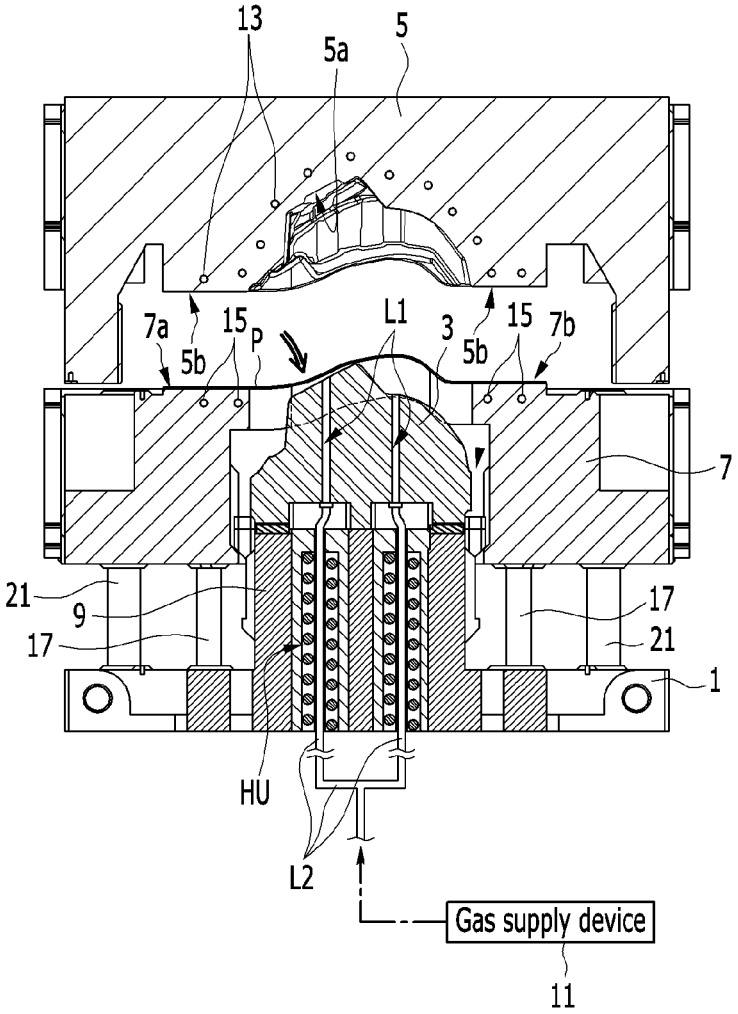
FIG. 5 to FIG. 8 show an operational state of a multi-warm forming device according to an exemplary embodiment of the present invention.

Firstly, as shown in FIG. 5, a material supply step S1 loads an aluminum alloy sheet (P) on a blank holder 7 that is mounted on the lower mold die 1 through a guide post 21 and a cushion spring 17 corresponding to a lower mold 3 that is mounted on the lower mold die 1 and a circumference of the lower mold 3.

Figure 6:
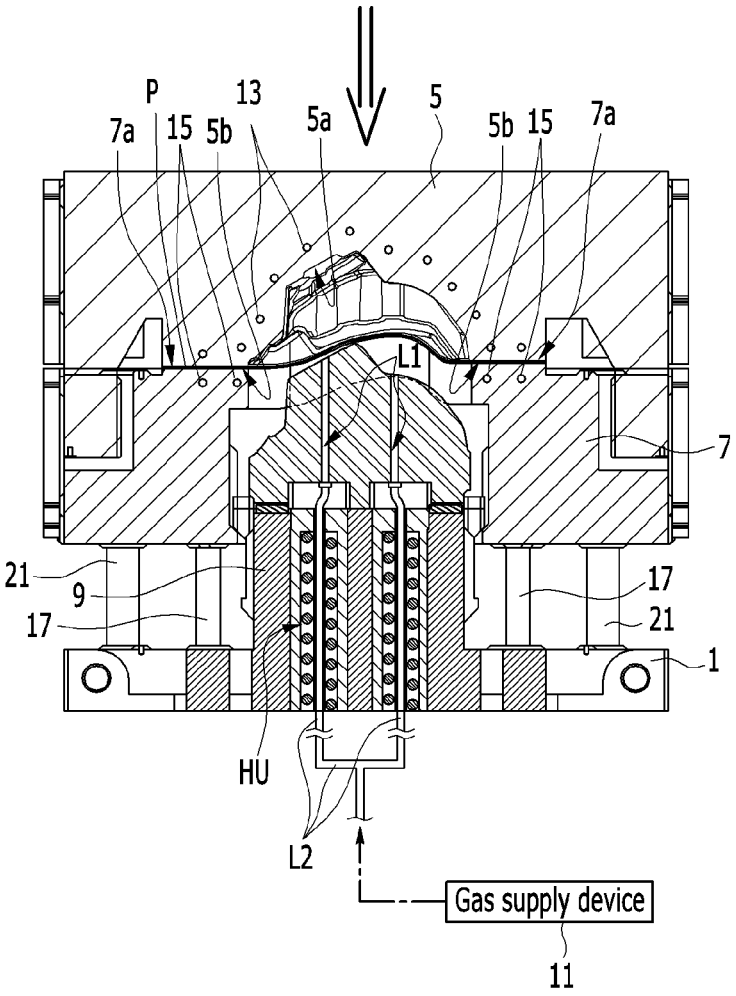

Subsequently, as shown in FIG. 6, a material heating step S2 heats the aluminum alloy sheet (P) to a warm-forming temperature through a heating cartridge 13 disposed inside the upper mold 5 and the blank holder 7, wherein an upper mold 5 is firstly lowered by a slider (not shown) at an upper portion of the lower mold 3 and the upper mold 5 holds an edge of the aluminum alloy sheet (P) together with the blank holder 7.

Here, an edge of the aluminum alloy sheet (P) is held by an upper mold face surface 5*b* and a holder face surface 7*a* between the upper mold 5 and the blank holder 7, and the warm forming temperature set to a value below an annealing temperature that lowers dislocation density within an aluminum alloy sheet (P) having a super-plasticity characteristic.

Figure 7:
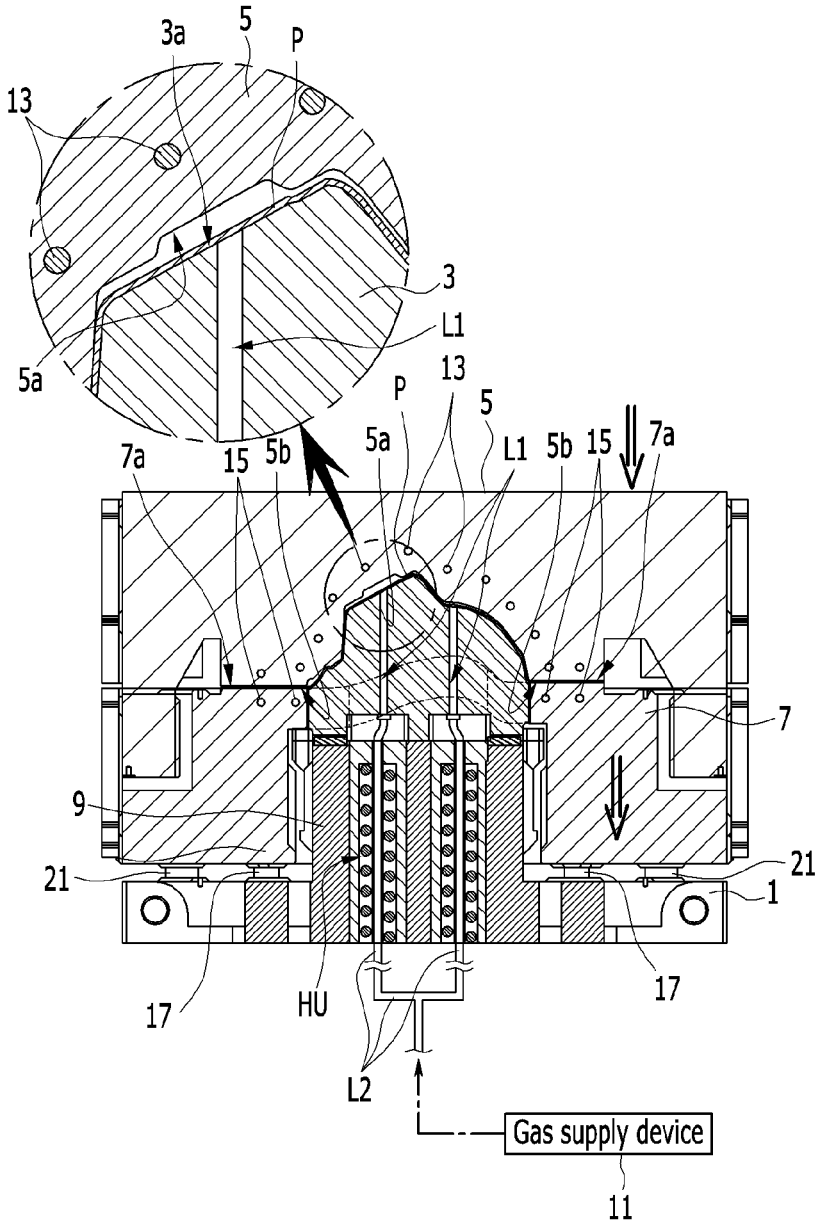

Then, the warm forming step S3 is performed, and as shown in FIG. 7, the warm forming step S3 combines the upper mold 5 with the lower mold 3 through an operation of the slider (not shown) at the warm forming temperature, wherein the aluminum alloy sheet (P) is formed to a maximum forming depth by plastic deformation that is caused by pressurization.

The aluminum alloy sheet (P) is plastically deformed to a maximum forming depth by a warm forming process to have a first forming shape.

Figure 8:
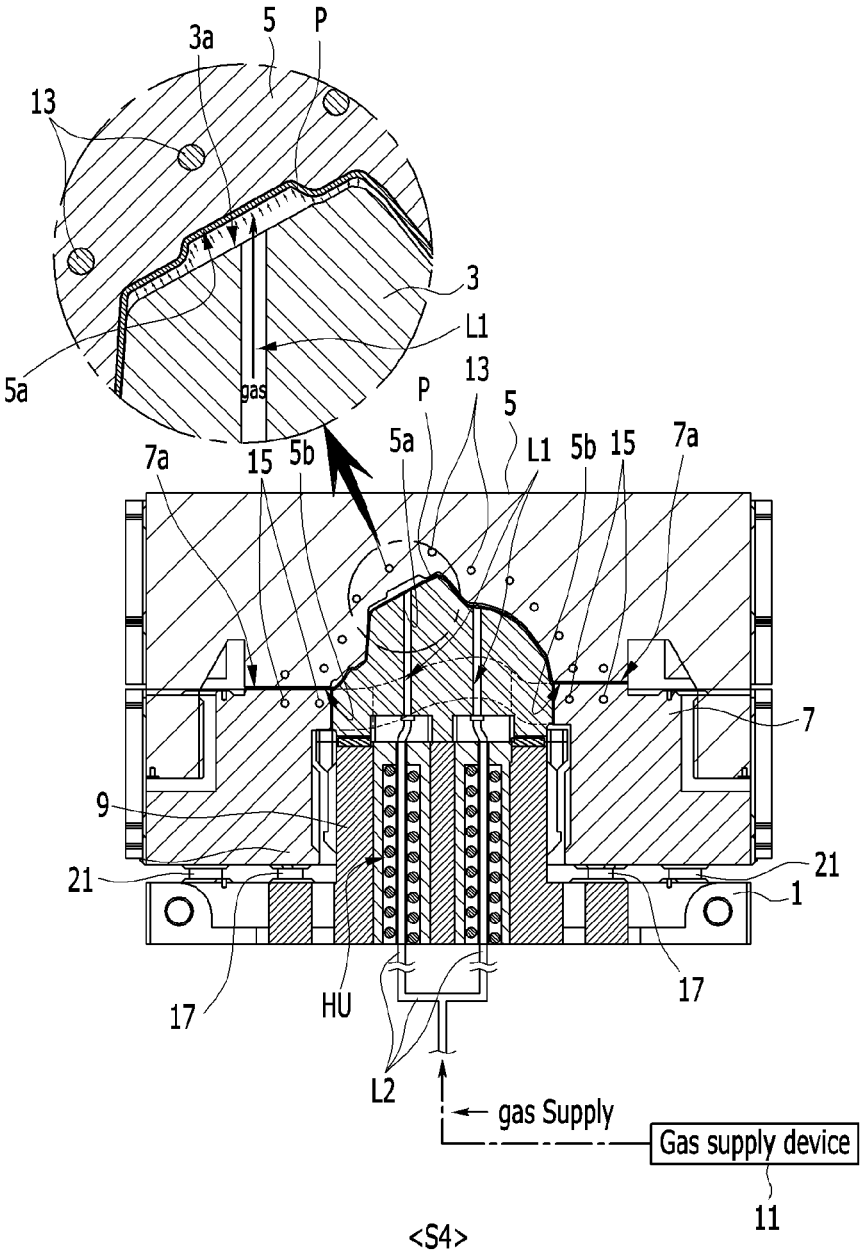

In this condition, the blow-forming step S4 is performed, as shown in FIG. 8, and the blow-forming step S4 uses the heating cartridges 13 and 15 to further heat the aluminum alloy sheet (P) that is formed to a maximum forming depth to a super-plasticity temperature, in a condition in which the upper mold 5 is combined with the lower mold 3, supplies a high pressure forming gas through a gas supply passage L1 that is formed inside the lower mold 3, and inflates the aluminum alloy sheet (P) through gas pressure along the upper forming surface 5*a* of the upper mold 5 such that the aluminum alloy sheet (P) is formed to a final shape of a complicated product.

At this time, the forming gas is supplied through a gas supply line L2 from an outside gas supply device 11, is heated to a high temperature while passing a heating unit (HU), and is supplied through a gas supply line L2 to the inside the lower mold 3.

In processes according to the forming method of the multi-warm forming device, the heat energy inside the upper mold 5 and the lower mold 3 is conserved by the insulating case 19 that is made of an insulating plate member having fine porosity and is mounted on each outside surface of the upper mold 5 and the blank holder 7 such that the heat loss is minimized to perform the processes.

As described above, a multi-warm forming device and a forming method thereof according to an exemplary embodiment of the present invention perform warm forming that forms a material to a maximum forming depth through pressurized plastic deformation below an annealing temperature that lowers dislocation density within an aluminum alloy sheet (P) having a super-plasticity characteristic and then heats an aluminum alloy sheet to a super-plasticity temperature to perform blow-forming that forms a material to a final product shape such that a product can be produced to have a deep forming depth and a complicated shape, and therefore it is not necessary to prepare a separate mold.

Further, in a multi-warm forming device and a forming method thereof according to an exemplary embodiment of the present invention, the number of components is reduced and the cost can be saved through a minimized number of processes when a product of which a forming depth is deep and a shape is complicated is formed, and therefore there is a merit in terms of cost, and complicated parts in the product are formed through blow-forming in which a gas pressure enlarges the material through non-contact with a mold and thus there is a merit of minimizing the defect rate compared with a conventional die casting method.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

1: lower mold die
3: lower mold
5: upper mold
7: blank holder
9: mold mounting portion
11: gas supply device
13, 15: heating cartridge
17: cushion spring
19: insulating case
21: guide post
HU: heating unit
SP: space portion
L1: gas supply passage
L2: gas supply line
H1, H2: penetration hole
3*a*: lower forming surface
5*a*: upper forming surface
5*b*: upper mold face surface
7*a*: holder face surface

What is claimed is:

1. A multi-warm forming device, comprising:

a lower mold die that is disposed on a bolster for a process and has a mold mounting portion having at least one space portion and disposed at a center of the lower mold die;

a lower mold that is disposed at an upper surface of the mold mounting portion of the lower mold die, wherein a plurality of gas supply passages formed in the lower mold in a vertical direction are connected to a gas supply device through a gas supply line, and a lower forming surface is formed at an upper surface of the lower mold;

an upper mold that is mounted on a slider and disposed on an upper side of the lower mold die and to be movable in the vertical direction at a position corresponding to the lower mold, wherein the upper mold has an upper forming surface facing and corresponding to the lower mold, and an upper mold face surface formed at a circumference of the upper forming surface, and wherein the upper mold has a plurality of heating cartridges mounted inside of the upper mold and distributed along the upper forming surface and the upper mold face surface;

a blank holder that has a penetration hole into which the mold mounting portion is inserted and is movable in the vertical direction by a guide post and a cushion spring that are mounted within the lower mold die, wherein the blank holder has a plurality of heating cartridges mounted inside of the blank holder and distributed along a holder face surface that restrains a material for the process together with the upper mold face surface at an early stage of the process; and a heating unit installed inside the space portion of the mold mounting portion, wherein the gas supply line that is connected to the gas supply device is connected to the gas supply passages through the space portion of the mold mounting portion and the gas supply line penetrates a central portion of the heating unit.

2. The multi-warm forming device of claim 1, wherein the material is a super-plasticity material.

3. The multi-warm forming device of claim 2, wherein the material is an aluminum alloy plate.

4. The multi-warm forming device of claim 1, further comprising an insulating case that is mounted on an outside surface of the upper mold and the blank holder to preserve heat energy.

5. The multi-warm forming device of claim 4, wherein the insulating case is made of a micro-porosity panel that is assembled on each outside surface of the upper mold and the blank holder.

6. The multi-warm forming device of claim 1, wherein a plurality of key grooves are formed at the upper surface of the mold mounting portion of the lower mold die and a lower surface of the lower mold, further comprising a plurality of restraining keys that are inserted into the key grooves to fix the lower mold on the lower mold die.

7. The multi-warm forming device of claim 6, wherein the upper surface of the mold mounting portion of the lower mold die is formed as a flat mold mounting surface.

8. The multi-warm forming device of claim 1, wherein the heating unit includes a heater housing in which a penetration hole is formed at a center of the heater housing and a heating coil that is wound in the heater housing.

9. The multi-warm forming device of claim 1, wherein an outside of the heating unit is covered by a heat insulating material in the space portion of the mold mounting portion.

10. The multi-warm forming device of claim 1, wherein the lower forming surface is formed as an unfinished product shape to be able to form the material to a maximum forming depth.

11. The multi-warm forming device of claim 1, wherein the upper forming surface is formed as a complete product shape to be able to form the material to a final complete shape.

12. A multi-warm forming method, comprising:

seating a plate made of a super-plasticity material on a blank holder that is disposed around a lower mold, the lower mold is mounted to a lower mold die;

heating the plate by using a heating cartridge within the blank holder to a warm forming temperature;

forming the plate to a maximum forming depth by combining an upper mold with the lower mold; and heating the plate formed to the maximum forming depth by using the heating cartridge; and blow-forming the plate heated and formed to the maximum forming depth by supplying a high pressure gas through a gas supply passage formed in the lower mold, wherein the gas supply passage is connected to a gas supply device and receives the high pressure gas through a gas supply line and wherein the gas supply line is surrounded by a heating unit that is installed inside the lower mold die and supplies heat energy to the high pressure gas passing through the gas supply line.

13. The multi-warm forming method of claim 12, wherein an aluminum alloy plate is applied as the super-plasticity material.

14. The multi-warm forming method of claim 12, wherein an insulating case that is made of a micro-porosity panel is mounted on an outside surface of the upper mold and the blank holder to preserve heat energy.

15. The multi-warm forming method of claim 12, wherein a lower forming surface of the lower mold is formed as an unfinished product shape to be able to form the plate to the maximum forming depth.

16. The multi-warm forming method of claim 12, wherein an upper forming surface of the upper mold is formed as a complete product shape to be able to form the plate to a final complete shape.

17. The multi-warm forming method of claim 12, wherein the warm forming temperature is set to a value below an annealing temperature that lowers a dislocation density of the plate.

* * * * *